United States Patent [19]

Horsewell et al.

[11] Patent Number: 4,660,576

[45] Date of Patent: Apr. 28, 1987

[54] SMOKING ARTICLES

[75] Inventors: Henry G. Horsewell, Totton; Martin G. Duke, Southampton, both of England

[73] Assignee: British-American Tobacco Company Limited, London, England

[21] Appl. No.: 713,183

[22] Filed: Mar. 18, 1985

[30] Foreign Application Priority Data

Mar. 23, 1984 [GB] United Kingdom ..... 8407671

[51] Int. Cl.[4] ..... A24D 3/04

[52] U.S. Cl. ..... 131/336; 131/339; 131/341

[58] Field of Search ..... 131/336, 338–341

[56] References Cited

U.S. PATENT DOCUMENTS

| | | | |
|---|---|---|---|
| 2,822,813 | 2/1958 | Downs | 131/4 |
| 2,958,328 | 11/1960 | Bartolomeo | 131/9 |
| 3,678,941 | 7/1972 | Dixon | 131/336 |
| 3,860,011 | 1/1975 | Norman | 131/5 |
| 4,362,171 | 12/1982 | Johnson et al. | 131/336 |
| 4,515,170 | 5/1985 | Cantrell et al. | 131/336 |

*Primary Examiner*—Vincent Millin
*Assistant Examiner*—H. Macey
*Attorney, Agent, or Firm*—Kane, Dalsimer, Kane, Sullivan and Kurucz

[57] ABSTRACT

A mouthpiece element for a cigarette comprises a duct which extends from the periphery of the element at a first location, spaced from the mouth end of the element, to the mouth end of the element at a second location, spaced from the periphery of the element. The element is attached to a cigarette rod by tipping which permits the ingress of air to the duct at the first location. Preferably, during smoking the ratio of the velocity of air issuing from the duct at the second location to the velocity of smoke issuing from the mouth end of the element is in excess of at least ten.

13 Claims, 6 Drawing Figures

SMOKING ARTICLES

This invention relates to mouthpiece elements for smoking articles, particularly but not exclusively cigarettes, or holders therefore. So-called ventilated cigarette filters are known which comprise a body of filtration material wrapped in air impervious wrapping means in which are formed a plurality of shallow grooves disposed at the periphery of the filter and extending to the mouth end of the filter. The grooves are typically 0.75 mm deep. A tipping overwrap is provided with ventilation perforations some of which overlie the grooves. When a cigarette incorporating such a filter is smoked, tobacco smoke is drawn through the filtration material and ventilation air is drawn through the perforations and into the shallow grooves. Not until the air issues from the mouth end of the grooves does it come into contact with the tobacco smoke. Such filters may be termed "segregated peripheral ventilation (SPV) filters". The air issues from each of the grooves of an SPV filter as a jet. These jets may cause changes in the pattern of the said smoke issuing from the body of filtration material and it has been discovered that changes in this pattern can affect advantageously the smoker's sensory perception of the smoke.

SPV filters are described in United Kingdom Patent Application Publication No. 2 046 573A.

We have determined that two factors are of importance in obtaining desired smoke patterns and, by selection or application of these two factors in combination, patterns may be obtained which are different from those which have been obtainable from SPV filters.

The first factor is the ratio of air velocity to smoke velocity at exit from the filter. We have found that this ratio should be in excess of ten (10), and preferably in excess of twenty (20), when the smoking takes place under standard machine-smoking conditions. The second factor relates to the degree of contact between the air and the smoke at exit from the filter; the greater the degree of contact, the greater disturbance effect will the air have on the smoke.

In the United Kingdom Patent Application Publication No. 2 100 573A, there is described a cigarette mouthpiece device in the use of which segregated ventilation air issues from the centre of the mouth end of the mouthpiece and tobacco smoke issues from the remaining proportion of the mouth end. Since the air jet is surrounded by smoke, the degree of contact between air and smoke is better than is the case with an SPV filter and thus it could be expected that the smoke pattern would be affected to a greater extent. However, the mouthpiece is of complex construction and may be difficult and expensive to make.

It is an object of the present invention to provide an improved device which is simple and inexpensive to manufacture, whilst maintaining full effectiveness in the control of smoke patterns.

As used herein, the term "mouthpiece element" refers to an element incorporated, or to be incorporated, in a smoking article at the mouth end thereof, or an element being, or forming part of, a smoking article holder. Such an element, or a portion thereof, may take the form of a filter.

The present invention provides a mouthpiece element comprising a smoke passage extending form end-to-end of said element and a continuous ventilation duct extending from a location in the region of the periphery of said element and distant the mouth end thereof to said mouth end at a location spaced from the periphery of said element, the wall of said duct being substantially gas impervious.

The ventilation duct may be substantially straight throughout its length. Alternatively, it may be curved over the whole or part of its length. There should preferably be no sudden reduction in the cross-sectional area of the duct in the air-flow direction thereof, i.e. in direction towards the mouth end of the element, except that a construction may be formed in the duct at the mouth end in order to increase the velocity of the ventilation air as it issues from the duct.

At the peripheral location from which the ventilation duct extends, the mouthpiece element is advantageously provided with a shallow groove extending circumferentially of the element, in which case the duct opens from the groove.

The duct may be provided by a length of tube of gas-impervious material or may, in a case in which the duct extends through a body of filtration material, cellulose acetate for example, take the form of a bore extending through the filtration material and having walls which have been rendered substantially gas-impervious, by, for example, the application thereto of a sealant material.

When the duct extends from a shallow groove, the walls of the groove are preferably rendered gas-impervious.

As an alternative to the mouthpiece element comprising a plug of filtration material through which the ventilation duct extends, the mouthpiece element can take the form of a generally tubular body of plastics or other material, the duct being provided in the form of a tube disposed within the body. These two elements may be formed as an integral unit.

The ventilation duct may be one of a plurality of similarly formed such ducts. If a plurality of ducts is provided, the ducts are suitably disposed symmetrically of the longitudinal axis of the mouthpiece element.

If only a single duct is provided and the cross-section of the duct is circular or similar, the downstream end of the duct, i.e. that opening at the mouth end of the mouthpiece element, is preferably concentric with the mouth end of the mouthpiece. In such case, a length of the duct extending to the downstream end thereof is advantageously disposed substantially co-axially of the mouthpiece element. Where a plurality of circular or similar cross-section ducts is provided, the respective downstream ends thereof should preferably be disposed close to the centre of the mouth end of the mouthpiece element, suitably within a notional circle of half the radius of that of the mouth end of the mouthpiece element.

When a mouthpiece element in accordance with the present invention is incorporated in a cigarette or other smoking article, the element will usually be attached to the smoking material rod by means of a tipping wrapper. It is a requirement of such tipping wrapper that it permits the passage of air therethrough in to the upstream end(s) of the ventilation duct(s). There may be disposed between the mouthpiece element and the smoking material rod a filter plug of known form, a cellulose acetate or paper filter plug for example, and the tipping wrapper may be such as to permit the passage of air therethrough into the plug.

According to a further aspect of the present invention there is provided a smoking article comprising a smoking material rod, a mouthpiece element and wrapper means extending about said element, said element comprising a smoke passage extending from end-to-end of said element and a continuous ventilation duct extending from a first location, in the region of the periphyer of said element and distant the mouth end thereof, to said mouth end at a second location, spaced from the periphery of said element, said wrapper means permitting the passage of air therethrough into said duct at said first location. Preferably, the ratio of the velocity of air issuing from the mouth end of the duct to the velocity of smoke issuing from the mouth end of the smoke passage is in excess of ten, and more preferably in excess of twenty, when the smoking article is smoked under standard machine-smoking conditions.

Under standard machine-smoking conditions, puffs of 35 $cm^3$ and two seconds duration are taken at intervals of one minute.

In order that the invention may be clearly understood and readily carried into effect, reference will now be made, by way of example, to the accompanying diagrammatic drawing, in which.

Figure 1:
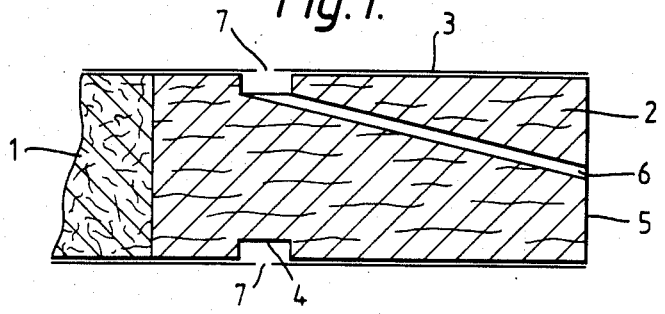
FIG. 1 shows, in axial section, parts of a cigarette comprising a mouthpiece element.

The cigarette of which parts are shown in FIG. 1 comprises a paper wrapped tobacco rod 1 and a mouthpiece element in the form of a self-sustaining, cylindrical filter plug 2 of cellulose acetate fibres. The tobacco rod 1 and the filter plug 2 are interattached by a tipping wrapper 3.

A shallow groove 4 extends around the plug 2 at a location thereof distant mouth end 5 thereof. The base and side walls of the groove are preferably gas-impervious, either as a result of a thermal moulding process by which the groove 4 is formed or because of the application to these surfaces of a sealant material. Extending from the groove 4 to the centre of the mouth end 5 of the plug 2 is a straight bore 6 providing a ventilation duct. Preferably, the wall of the bore 6 has been rendered gas-impervious by, for example, the application of a sealant material.

The tipping wrapper 3, which is otherwise air-impervious, is provided with a line or zone of perforations, designated 7, which encircles the filter plug 2 at the location of the groove 4.

When the cirgarette of FIG. 1 is smoked, air is drawn through the perforations 7 into the groove 4 and therefrom through the bore 6. At the same time, tobacco smoke is drawn through the body of cellulose-acetate fibres of the plug 2. The smoke issues from the mouth end 5 of the plug 2 as an annular stream surrounding the axial jet of air issuing from the bore 6. The cross-sectional area of the bore 6 is so selected as to ensure that the velocity of the air is well in excess, by a factor of at least more than ten, of the velocity of the smoke. Because the jet of air issuing from the bore 6 is completely surrounded by smoke and because the air/smoke velocity ratio is high, a marked effect on the smoke pattern is obtained.

If, for example, the cross-sectional area of the bore 6 is 2 $mm^2$, the annular cross-sectional area of the smoke passage in plug 2 is 48 $mm^2$ and the relative pressure drops of the ventilation air and tobacco smoke paths through the plug 2 are such that the ventilation level is 50%, then the air/smoke velocity ratio will be about twenty-four, when measured under standard machine-smoking conditions.

Instead of the plug 2 being of a self-sustaining structure, it may comprise a plugwrap, which plugwrap includes or is composed of thermoplastic fibres. When a thermal mounding process is used to form the shallow groove 4, the thermoplastic nature of the plugwrap ensures that the base and side walls of the groove 4 are rendered gas-impervious even if the plugwrap is initially of a pervious nature.

Although the bore 6 is depicted in FIG. 1 as being straight, it could alternatively follow a path which is curved over part or the whole of its length. Another variation would be for the plug 2 to be provided with two or more bores extending from the groove 4, the respective downstream ends of the bores being symmetrically disposed about the centre of the mouth end 5 of the plug 2. Instead of being provided by a bore(s), the ventilation-duct means could be provided by a tube length(s).

Figure 2:
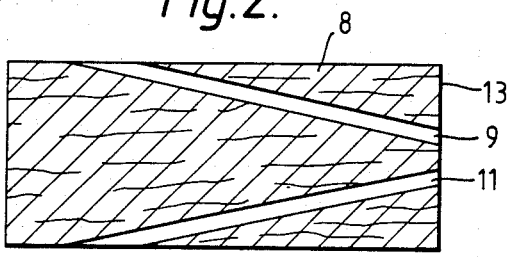
FIG. 2 shows, in axial section, a form of mouthpiece element different from that of the cigarette of FIG. 1.
Figure 3:
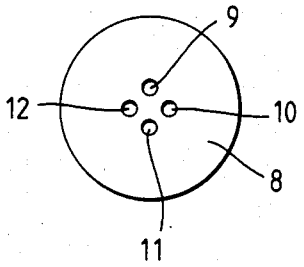
FIG. 3 shows an end view of the element of FIG. 2.

An alternative form of mouthpiece element is provided by the self-sustaining, cylindrical filter plug, designated 8, shown in FIGS. 2 and 3. Four tube lengths 9–12, providing ventilation ducts, extend from locations at the periphery of the plug 8, and equiangularly spaced thereabout, to mouth end 13 of the plug 2. As can be seen from FIG. 3, the downstream ends of tube lengths 9–12 are symmetrically disposed about the centre of the mouth end 13 of the plug 8.

The plug 8 would be attached to a tobacco rod by a tipping wrapper provided with perforations through those of which in register with the upstream ends of the tube lengths 9–12 ventilating air could enter the tube lengths. The tube lengths 9–12 could be curved, thus, for example, to provide that the ventilating air passed from the downstream ends of the tube lengths in a direction parallel with the longitudinal axis of the plug 8.

The internal cross-sectional area of each of the tube lengths 9–12 is so selected that the velocity of the air exceeds, by a factor of at least more than ten, the velocity of the smoke as the smoke issues from the mouth end 13 of the filter plug 8.

Figure 4:
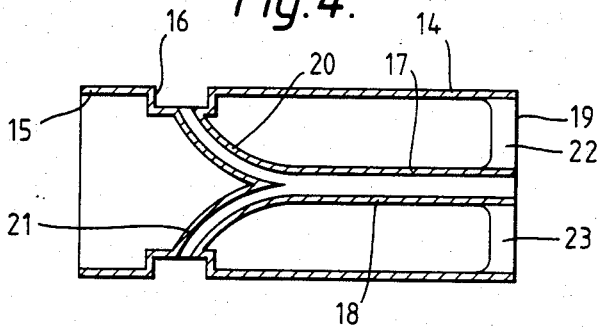
FIG. 4 shows, in axial section, a further form of mouthpiece element.

The mouthpiece element of FIG. 4, designated 14, is formed of a plastics material and comprises a tubular body part 15, the wall of which at a location near the upstream end of the mouthpiece is recessed to provide a groove 16 which extends around the mouthpiece. Disposed within the body part 15 is ventilation duct means in the form of a tube structure 17. A first portion 18 extends co-axially of the mouthpiece element 14 from mouth end 19 thereof and, second, curved portions 20, 21 extend from the first portion 18 to the base of the groove 16. Four equiangularly spaced webs, two of which, designated 22 and 23, are shown in FIG. 4, serve to support the first portion 18 of the structure 17 at the mouth end 19 of the element 14.

In attaching the mouthpiece element 14 to a tobacco rod, a tipping wrapper is used which is provided with perforations at the location of the groove 16. A filter plug may be disposed to the upstream end of the element 14 and may be received within the body part 15 at the upstream side of the groove 16.

Although the mouthpiece element of FIG. 4 comprises a tube structure 17 of bifurcated form, it will be understood that two or more separate ventilation ducts could alternatively be provided, the ducts extending from respective locations of the groove 16 to respective locations at the mouth end of the element.

Figure 5:
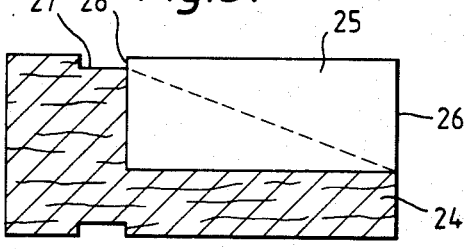
FIG. 5 shows a yet further form of mouthpiece element.
Figure 6:
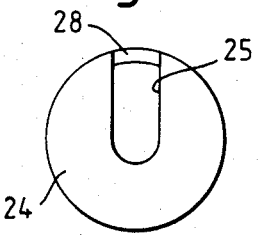
FIG. 6 shows an end view of the element of FIG. 5.

The mouthpiece element shown in FIGS. 5 and 6 takes the form of a self-sustaining, cylindrical filter plug, designated 24, which is provided with a deep groove 25 extending radially inwards from the periphery of the plug 24 and extending from mouth end 26 of the plug 24, at constant depth and with constant cross-section, for a major proportion of the length of the plug 24. The plug 24 is also provided with a shallow groove 27 which extends around the plug 24. At a location designated 28 (FIGS. 5 and 6), the groove 27 communicates with the groove 25. Thus the groove 25 provides a ventilation duct extending from the location 28 to the mouth end 26 of the plug 24. Preferably, each of the grooves 25 and 27 has gas-impervious walls.

In attaching the filter plug 24 to a tobacco rod, a tipping wrapper is used which is provided with perforations at the location of the groove 27.

If the plug 24 has an overall cross-sectional area of 0.5 $cm^2$ and the cross-section of the groove 25 accounts for 0.1 $cm^2$ of this, then at an 85% ventilation level, the air/smoke velocity ratio under standard machine-smoking conditions will be about twenty-three. If a width of groove of 2 mm is selected and the base of the groove is of semi-circular form, the overall depth of the groove will be 5.22 mm. In such case the perimeter of of the groove, which determines the boundary between the air and tobacco smoke streams, will be about 11.6 mm in length. Such a long boundary ensures a very high degree of contact between the air and the smoke at exit from the plug 24, and this factor, together with the high air/smoke velocity ratio, ensures a very adequate disturbance effect of the air on the smoke. The result is the production of a smoke pattern which enhances the smoker's sensory perception of the smoke.

Although the groove 25 has been described as being of a constant cross-section throughout its length, it could be of an increasing cross-section in the direction towards the mouth end 26 of the plug 24. Thus the groove 25 could, for example, be of increasing depth, the base of the groove 25 extending from the base of the groove 27 at the location 28. This is indicated by the broken line in FIG. 5.

Two or more grooves, preferably not more than three, could be provided, the total cross-sectional areas of which must not exceed the area which results in the attainment of the required air/smoke velocity ratio at a given filter ventilation level. If more than a single groove is employed, it may be advisable for the width of each groove to be less than that of a single equivalent groove so as to provide long air/smoke boundaries. In any case, the depth of each groove should not be less than 2 mm.

A mouthpiece element in accordance with the present invention may incorporate or be used in conjunction with a hollow tubular element which extends from the mouth end of the mouthpiece element, so that the air and smoke which issue from the mouthpiece element pass through the tubular element. The tubular element, which may have any suitable length from about 7 mm, is suitably formed of heavy paper, card or a plastic material. It may incorporate internal, transversely extending bracing members.

It has been noticed that when such a tubular element is used, the high air/smoke velocity ratio and long air/smoke boundary conditions are still effective in promoting desirable smoke patterns.

What is claimed is:

1. A mouthpiece element comprising:

a smoke passage defined by a downstream end and an upstream end, a peripheral wall extending between said ends, a continuous ventilation duct extending from a region of said peripheral wall open to ambient air, to said downstream end, said duct being substantially gas imperivous and opening at said downstream end at a location spaced from said peripheral wall to permit smoke flowing through said passage to exit through said downstream end outwardly of air exiting from said duct, said duct and said smoke passage having cross-sectional dimensions selected to provide a ratio between an air velocity of air exiting from the duct and a smoke velocity of smoke exiting from the smoke passage, which ratio exceeds ten when the element is smoked under standard smoke machine conditions.

2. A mouthpiece element as claimed in claim 1, in which said ventilation duct is substantially straight throughout the length thereof.

3. A mouthpiece element as claimed in claim 1 or 2, in which said region comprises a shallow groove extending circumferentially of said element and said ventilation duct at the end thereof remote the mouth end of said element opens from said groove.

4. A mouthpiece element as claimed in claim 3, in which the walls of said groove are substantially gas impervious.

5. A mouthpiece element as claimed in claim 1, in which said ventilation duct is in the form of a length of tube of gas impervious material.

6. A mouthpiece element as claimed in claim 5, said element being a generally tubular body of plastics material.

7. A mouthpiece element as claimed in claim 6, in which said length of tube is integral with said body.

8. A mouthpiece element as claimed in claim 1, in which said ventilation duct extends within a body of filtration material of said smoke passage and is in the form of a bore formed in said body, the walls of said bore being rendered substantially gas impervious.

9. A mouthpiece element as claimed in claim 1, in which said ventilation duct opening is concentric with said downstream end.

10. A mouthpiece element as claimed in claim 1, in which said ventilation duct is one of a plurality of similar ventilation ducts.

11. A smoking article comprising a smoking material rod, a mouthpiece element having an upstream end, a downstream and a peripheral wall and wrapper means extending about said element, said element comprising a smoke passage extending between said ends and a substantially gas impervious, continuing ventilation duct extending from a first location in a region of peripheral wall to a second location, at said downstream end spaced from the peripheral wall, said wrapper means having means for permitting the passage of air therethrough into said duct at said location to permit smoke from said passage to exit said downstream end between said second location and said peripheral wall, said element and duct having cross-sectional dimensions selected to provide a ratio of the velocity of air issuing from said duct at said second location to the velocity of smoke issuing from said smoke passage in excess of ten when said smoking article is smoked under standard machine-smoking conditions.

12. A smoking article as claimed in claim 11, said velocity ratio being in excess of twenty.

13. A smoking article as claimed in claim 11 wherein said wrapper means comprises a tubular member concentrically disposed about said mouthpiece element.

* * * * *

UNITED STATES PATENT AND TRADEMARK OFFICE

CERTIFICATE OF CORRECTION

PATENT NO. : 4,660,576

DATED : April 28, 1987

INVENTOR(S) : Henry G. Horsewell

It is certified that error appears in the above—identified patent and that said Letters Patent is hereby corrected as shown below:

Col. 1, line 66; "form" should read -- from -- .

Col. 2, line 10; before the word "direction" insert -- the -- .

Col. 2, line 11; "construction" should read -- constriction -- .

Col. 3, line 5; "periphyer" should read -- periphery -- .

Col. 4, line 12; "mounding" should read -- moulding -- .

Signed and Sealed this

Fifth Day of January, 1988

*Attest:*

DONALD J. QUIGG

*Attesting Officer*

*Commissioner of Patents and Trademarks*